US010287933B2

(12) United States Patent
Ikemi et al.

(10) Patent No.: US 10,287,933 B2
(45) Date of Patent: May 14, 2019

(54) ASSEMBLY OF INTERNAL COMBUSTION ENGINE VALVE AND VALVE SEAT

(71) Applicants: NIPPON PISTON RING CO., LTD., Saitama (JP); NITTAN VALVE CO., LTD., Kanagawa (JP)

(72) Inventors: Satoshi Ikemi, Tochigi (JP); Hiroshi Oshige, Tochigi (JP); Kiyoshi Suwa, Tochigi (JP); Kenichi Sato, Tochigi (JP); Kouji Kunitake, Kanagawa (JP); Ryouichi Yoshino, Kanagawa (JP)

(73) Assignees: NIPPON PISTON RING CO., LTD., Saitama (JP); NITTAN VALVE CO., LTD., Kanagawa (JP)

( * ) Notice: Subject to any disclaimer, the term of this patent is extended or adjusted under 35 U.S.C. 154(b) by 0 days.

(21) Appl. No.: 15/108,470

(22) PCT Filed: Dec. 17, 2014

(86) PCT No.: PCT/JP2014/083372
§ 371 (c)(1),
(2) Date: Jun. 27, 2016

(87) PCT Pub. No.: WO2015/098643
PCT Pub. Date: Jul. 2, 2015

(65) Prior Publication Data

US 2016/0326919 A1 Nov. 10, 2016

(30) Foreign Application Priority Data

Dec. 27, 2013 (JP) ..... 2013-273342

(51) Int. Cl.
*B22F 7/02* (2006.01)
*B22F 7/06* (2006.01)
(Continued)

(52) U.S. Cl.
CPC ..... *F01L 3/14* (2013.01); *B22F 7/02* (2013.01); *B22F 7/062* (2013.01); *C22C 33/02* (2013.01);
(Continued)

(58) Field of Classification Search
CPC ..... F01L 3/02; F01L 3/04; F01L 3/20; F01L 3/14; F01L 3/22
See application file for complete search history.

(56) References Cited

U.S. PATENT DOCUMENTS 4,834,036 A * 5/1989 Nishiyama ..... B23P 15/002 123/188.2
5,358,212 A * 10/1994 Soltys ..... B08B 9/0321 251/121
(Continued)

FOREIGN PATENT DOCUMENTS

JP 01-37466 8/1989
JP 02-124204 5/1990
(Continued)

OTHER PUBLICATIONS

International Search Report, PCT/JP2014/083372, dated Mar. 31, 2015.

*Primary Examiner* — Jacob M Amick
*Assistant Examiner* — Charles Brauch
(74) *Attorney, Agent, or Firm* — Young & Thompson

(57) ABSTRACT

In an assembly of a hollow poppet valve and a valve seat insert, the hollow poppet valve's head is integrally formed with a stem end, a hollow part is formed from the head to a stem, and coolant is filled into the hollow part along with an inert gas. The valve seat insert is formed of iron base sintered alloy and obtained by integrating two layers of a supporting material side layer and a valve contact face side layer. The hollow poppet valve is formed of a material having thermal conductivity of 5-45 (W/m·K) at 20-1000° C. The valve seat insert includes the supporting material side
(Continued)

layer having thermal conductivity of 23-50 (W/m·K) at 20-300° C. and a valve contact face side layer having thermal conductivity of 10-22 (W/m·K) at 20-300° C. This enables a valve temperature decrease throughout an engine's entire RPM range compared with the prior art.

8 Claims, 8 Drawing Sheets

(51) Int. Cl.

| | |
|---|---|
| ***F01L 3/02*** | (2006.01) |
| ***F01L 3/04*** | (2006.01) |
| ***F01L 3/14*** | (2006.01) |
| ***F01L 3/18*** | (2006.01) |
| ***F01L 3/20*** | (2006.01) |
| ***F01L 3/22*** | (2006.01) |
| ***C22C 33/02*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |
| ***C22C 38/52*** | (2006.01) |

(52) U.S. Cl.

CPC ..... *C22C 38/00* (2013.01); *F01L 3/02* (2013.01); *F01L 3/18* (2013.01); *C22C 38/002* (2013.01); *C22C 38/02* (2013.01); *C22C 38/04* (2013.01); *C22C 38/44* (2013.01); *C22C 38/46* (2013.01); *C22C 38/52* (2013.01); *F01L 3/04* (2013.01); *F01L 3/20* (2013.01); *F01L 3/22* (2013.01)

(56) References Cited

U.S. PATENT DOCUMENTS

| | | | | | |
|---|---|---|---|---|---|
| 5,649,358 | A * | 7/1997 | Adachi | ..... | F01L 3/22 29/888.4 |
| 5,765,520 | A * | 6/1998 | Adachi | ..... | F01L 3/22 123/188.8 |
| 5,769,037 | A * | 6/1998 | Ohtsubo | ..... | F01L 3/14 123/188.9 |
| 6,138,351 | A * | 10/2000 | Adachi | ..... | F01L 3/22 123/188.8 |
| 6,951,579 | B2 * | 10/2005 | Koyama | ..... | C22C 33/0228 419/14 |
| 2005/0252338 | A1 * | 11/2005 | Henmi | ..... | C22C 32/0089 75/246 |
| 2006/0162686 | A1 | 7/2006 | Heigl | | |
| 2010/0269778 | A1 * | 10/2010 | Yuen | ..... | F01L 3/22 123/193.5 |
| 2012/0304464 | A1 * | 12/2012 | Morii | ..... | B21D 53/84 29/888.45 |

FOREIGN PATENT DOCUMENTS

| | | | | | |
|---|---|---|---|---|---|
| JP | 2-33848 | | 7/1990 | | |
| JP | 04-76907 | | 3/1992 | | |
| JP | 07-279627 | | 10/1995 | | |
| JP | 2006002578 | A * | 1/2006 | | |
| JP | 2006-516313 | | 6/2006 | | |
| JP | 2006-183528 | | 7/2006 | | |
| JP | 2011-157845 | | 8/2011 | | |
| JP | WO 2013145250 | A1 * | 10/2013 | ..... | F01L 3/02 |
| WO | 2013/145250 | | 10/2013 | | |

* cited by examiner

ASSEMBLY OF INTERNAL COMBUSTION ENGINE VALVE AND VALVE SEAT

TECHNICAL FIELD

The present invention relates to a valve system for an internal combustion engine and particularly to an assembly of a valve and a valve seat insert capable of suppressing an increase in temperature of the valve by improving heat transfer ability.

BACKGROUND ART

In recent years, there has been a demand for higher output or performance in an internal combustion engine such as a gasoline engine. Further, in recent years, lower fuel consumption has been also demanded. When engine performance is improved in order to handle such a demand, a temperature of a combustion chamber increases, and hence a thermal load on an exhaust valve particularly increases.

Here, there is proposed a valve (a hollow poppet valve) in which a hollow part is formed from a head of a poppet valve having a stem and a head integrated with each other to the stem so as to decrease the weight of the valve and for example, coolant (refrigerant) such as metallic sodium having high thermal conductivity is enclosed in the hollow part along with an inert gas so as to improve the thermal conductivity of the valve (hereinafter, also referred to as a heat transfer effect of the valve). In such a valve, heat generated in a combustion chamber in accordance with the starting of an engine is actively transferred through the valve.

For example, Patent Literature 1 discloses a hollow valve for an internal combustion engine in which a hollow hole is drilled so as to be blocked at a head face along the axis of the stem from the head to the stem. In the hollow valve, a head face part is provided with a through-hole which is continuous to the hollow part and has a diameter smaller than the maximal inner diameter of the hollow part, a sealing member is fitted and adhered to the through-hole, and a boundary between a valve body and the sealing member is located near the center of the valve axis so as to avoid an acute part to which stress is likely to be concentrated. Accordingly, the durability and the reliability of the hollow valve are improved.

Further, Patent Literature 2 discloses a hollow valve for an internal combustion engine in which a cooling medium is enclosed in a hollow hole drilled from a head to a stem and an unevenness part is provided in at least an inner peripheral face of the hollow hole. Accordingly, the heat transfer efficiency to the cooling medium near the head is improved and hence the thermal load of the head is remarkably decreased when the valve is operated.

Meanwhile, even in a valve seat insert for a valve opening and closing an intake and an exhaust of an internal combustion engine, there has been a demand for keeping excellent cooling performance capable of suppressing an increase in peripheral temperature of a combustion chamber by radiating heat from the valve as well as wear resistance.

For such a demand, for example, Patent Literature 3 discloses a valve seat insert for an internal combustion engine which is formed of iron base sintered alloy and in which two layers of a seat-face side layer and a valve contact face side layer provided with a valve contact face are integrated with each other, the valve contact face side layer is 10 to 45% by a volume % with respect to the entire valve seat insert, a boundary face between the valve contact face side layer and the seat-face side layer preferably has an average angle of 20 to 90° with respect to the valve seat insert axis, and the boundary face is adjusted to ±300 μm at the average position in the height direction. Accordingly, it is possible to obtain a valve seat insert having excellent wear resistance and high thermal conductivity.

CITATION LIST

Patent Literature

Patent Literature 1: JP 02-124204 Y
Patent Literature 2: JP 04-76907 Y
Patent Literature 3: JP 2011-157845 A

SUMMARY OF INVENTION

Technical Problem

In the hollow poppet valve (the hollow valve) in which the coolant (the refrigerant) is enclosed in the hollow part formed in the head, heat moves in accordance with the flow of the coolant (the refrigerant) and hence an increase in temperature of the valve can be prevented to some extent. However, in the technique disclosed in Patent Literature 1, the durability and the reliability of the valve can be improved, but the remarkable improvement of the heat transfer effect of the valve cannot be expected. Further, in the technique disclosed in Patent Literature 2, the face area of the inner peripheral face of the hollow hole increases, and hence there is a tendency that the amount of heat transferred to the cooling medium increases. However, the flow of the cooling medium (the coolant) inside the hollow hole is distracted. Accordingly, it cannot be said that heat is sufficiently radiated from the head and it is not possible to expect the remarkable improvement of the heat transfer effect of the valve.

Further, in the techniques disclosed in Patent Literatures 1 and 2, when the amount of heat generated in the combustion chamber increases too much, there is a concern that the temperature of the head of the valve contacting an exhaust gas increases too much, because the amount of heat generated exceeds the heat transfer effect of the valve in accordance with the flow of the coolant (the refrigerant) inside the hollow hole. Further, when the valve is opened and closed, a large load is applied to a valve seat insert contact face, a head inclined face, or a neck part as a connection part between the head and the hollow stem of the valve. For that reason, when the valve temperature increases too much, there is a concern that a breakage occurs in a large-load part due to corrosion, abrasion, and degraded strength in accordance with an increase in temperature. Thus, a problem arises in that an engine trouble is caused. As a result, there is a need for the further improvement of the heat transfer effect of the valve to suppress an increase in temperature of the head.

Further, the technique disclosed in Patent Literature 3 is not sufficient to suppress an increase in temperature of the valve in accordance with the improvement of the engine performance in recent years and hence the further improvement of the heat transfer effect of the valve seat insert is demanded.

Further, in the related art, as described above, there are several proposals for the improvement of the heat transfer effect of the hollow poppet valve or the valve seat insert.

However, there is no mention for an appropriate assembling of the valve and the valve seat insert when the hollow valve is used.

The invention is made to solve the above-described problems of the related art and an object thereof is to provide an assembly of a hollow poppet valve and a valve seat insert for an internal combustion engine capable of remarkably suppressing an increase in valve temperature compared with the assembly of the valve and the valve seat insert using the solid valve in the related art.

Solution to Problem

In order to attain the above-described object, the present inventors first carried out various examinations to further improve the heat transfer effect of the hollow poppet valve (the hollow valve). As a result, it was considered that a circulation needed to be formed in the coolant (the refrigerant) inside the hollow part of the valve. When the circulation is formed in the entire coolant (the refrigerant) inside the hollow part, the coolant is mixed at the upper, middle, and lower layers and hence the heat transfer effect of the hollow valve is remarkably improved.

Specifically, as illustrated in FIG. 1, a hollow poppet valve (a hollow valve) 10 is provided in which a large-diameter hollow part S1 having a substantial disk shape and provided inside a head 13 communicates with a small-diameter hollow part S2 having a substantial bar shape and provided in a stem 11 in a direction substantially orthogonal to each other and an opening peripheral portion of the small-diameter hollow part S2 in the large-diameter hollow part S1 is formed as a plane 13*b* substantially orthogonal to a center axis line L of the valve 10.

In such a hollow poppet valve, an inner circulation of the longitudinal direction around the valve center axis line L was checked in the coolant inside the large-diameter hollow part S1 when the valve 10 was opened and closed by a simulation using a computer (see F1, F2, F3, F6, and F8 of FIGS. 2(*a*) and 2(*b*)). Further, FIG. 2(*a*) illustrates a case where the valve moves down and FIG. 2(*b*) illustrates a case where the valve moves up. Reference Numeral 8 indicates a valve seat insert.

Here, the inventors manufactured a hollow poppet valve having a structure illustrated in FIG. 1, assembled the valve to an automobile engine and measured a face temperature of a neck part of the valve by a thermocouple welded to the face of the valve after a heating operation (increasing a rotation speed gradually) was performed for a predetermined time and a high-load operation was continued for a predetermined time at a predetermined rotation speed. Further, as a comparison, the same experiment was also performed on the hollow poppet valve (FIG. 8(*b*)) of the related art having a smoothly continuous communicating part P between the large-diameter hollow part S1 and the small-diameter hollow part S2.

As a result, in the hollow poppet valve (FIG. 1) having the opening peripheral portion of the small-diameter hollow part S2 in the large-diameter hollow part S1 formed as the plane 13*b* substantially orthogonal to the center axis line L of the valve, it was found that the heat transfer property (the heat transfer effect) of the valve was obviously improved compared with the hollow valve (FIG. 8(*b*)) of the related art having a smoothly continuous communicating part P. Here, in the hollow valve of the related art having a smoothly continuous communicating part P illustrated in FIG. 8(*b*), coolant 19 smoothly moves between the large-diameter hollow part S1 and the small-diameter hollow part S2 in response to the opening/closing of the valve, but the coolant moves only in the axial direction in a fixed up/down relation while the upper, middle, and lower layers of the coolant are not mixed with one another. On the contrary, in the hollow valve in which the opening peripheral portion of the small-diameter hollow part S2 in the large-diameter hollow part S1 illustrated in FIG. 1 is formed as the plane 13*b* substantially orthogonal to the center axis line L of the valve, the inner circulation is formed in the axial direction.

Here, in the hollow poppet valve having a structure illustrated in FIG. 1, the face temperature of the valve obtained when the hollow poppet valve was assembled with the valve seat insert was examined by the thermocouple welded to the face thereof in order to check the effect of the actual engine. Further, the assembling of the solid valve and the valve seat insert was used as a reference. The solid valve had a shape illustrated in FIG. 8(*a*) and the valve seat insert was set as a general valve seat insert (a standard valve seat insert) formed of iron base sintered alloy and having a double-layer integrated structure illustrated in FIG. 4(*b*).

As a result, it was checked that an increase in valve temperature was suppressed when the engine rotation speed was at a high rotation speed zone in the assembling of the hollow valve and the valve seat insert (the standard valve seat insert) using the hollow poppet valve illustrated in FIG. 1 compared with the assembling of the solid valve and the valve seat insert (the standard valve seat insert). However, in this assembling, a problem that the heat transfer amount was small at the frequently used low-middle rotation speed zone of the engine rotation speed compared with the high rotation speed zone was found. It is speculated that this is because the heat transfer amount of the valve is small at the low-middle rotation speed zone since the coolant (the refrigerant) is not mixed at the upper and lower layers.

Therefore, a countermeasure for suppressing an increase in valve temperature through a wide range of the engine rotation speed zone was further examined. As a result, it was considered that a high thermal conduction type valve seat insert having high thermal conductivity needed to be used in addition to the use of the hollow poppet valve illustrated in FIG. 1 in order to increase the heat transfer amount by suppressing an increase in valve temperature at the low-middle rotation speed zone of the engine. Then, it was found that an increase in valve temperature could be suppressed until the engine rotation speed changed from the low-middle rotation speed zone to the high rotation speed zone by using the assembly of the valve and the valve seat insert, that is, the assembly of the hollow poppet valve having a high heat transfer effect and the valve seat insert having high thermal conductivity. When the thermal conductivity of the valve seat insert is low, an effect of suppressing an increase in valve temperature at the low-middle rotation speed zone is small even when the hollow valve having a high heat transfer effect is used.

First, an experiment result as a basis of the invention will be described.

As valves, the hollow poppet valve (the hollow valve having a high heat transfer effect) having a structure illustrated in FIG. 1 and the solid valve having a shape illustrated in FIG. 8(*a*) were prepared. Both valves were formed of heat-resistant steel (SUH 35). In addition, metallic sodium Na was enclosed in the hollow hole of the hollow poppet valve along with an inert gas.

Meanwhile, as valve seat inserts, a valve seat insert (a high thermal conduction type valve seat insert) having a dimensional shape illustrated in FIG. 5(*a*) and a valve seat insert (a standard valve seat insert) having a dimensional shape illustrated in FIG. 5(*b*) were prepared.

Further, in all valve seat inserts, the valve contact face side layer was formed of iron base sintered alloy having a base matrix in which hard particles were dispersed in a base matrix phase, the base matrix containing 1.0% of C, 40% of alloy elements of Co, Mo, Si, and Ni etc. in total and the balance being Fe and inevitable impurities by a mass %, and the supporting material side layer was formed of iron base sintered alloy containing 1.0% of C and the balance being Fe and inevitable impurities as a rest by a mass %. The valve contact face side layer with such a composition had thermal conductivity of 10 to 22 W/m·K at 20° C. to 300° C. and the supporting material side layer had thermal conductivity of 25 to 50 W/m·K at 20° C. to 300° C. according to a measurement based on a laser flash method.

Further, in the high thermal conduction type valve seat insert, the valve contact face side layer was formed so as to have a volume % of 26% with respect to the entire valve seat insert and the boundary face between the valve contact face side layer and the supporting material side layer was formed as a face including a point of 1.0 mm distant from the valve contact face toward the supporting material in a direction perpendicular to the valve contact face at the center position of the valve contact face in the width direction at the valve seat insert cross-section, a point of ⅘ of the valve seat insert height as a distance from the valve seat insert seating face on the outer peripheral face of the valve seat insert, and a point distant from the seat face of the valve seat insert inner peripheral face by 2.5 mm. Meanwhile, in the standard valve seat insert, the valve contact face side layer was formed so as to have a volume % of 51% with respect to the entire valve seat insert and the boundary face between the valve contact face side layer and the supporting material side layer was formed as a face of 90° with respect to the valve seat insert axis.

The assembly of the valve and the valve seat insert was assembled to a gasoline engine (having a capacity of 1.8 liter and an in-line four cylinder) for an automobile. The assembly of the valve and the valve seat insert was set as an assembly (No. a) of the solid valve and the standard valve seat insert, an assembly (No. b) of the solid valve and the high thermal conduction type valve seat insert, an assembly (No. c) of the hollow valve and the standard valve seat insert, and an assembly (No. d) of the hollow valve and the high thermal conduction type valve seat insert. Further, the valve face temperature was measured with a thermocouple being welded to the neck part of the valve.

A warming up operation was performed for a predetermined time and a high-load operation was performed at a predetermined rotation speed. At this operation condition, the valve face temperature was measured. The predetermined rotation speed was set to about 1000 to 5500 rpm.

The obtained result is illustrated in FIG. 6 as a relation between the engine rotation speed and the valve face temperature. From FIG. 6, it is understood that an increase in valve face temperature is strongly suppressed in the assembly Nos. c and d of the valve and the valve seat insert using the assembly of the hollow poppet valve regardless of the type of the valve seat insert compared with the case of the assembly No. a of assembling the solid valve and the standard valve seat insert. Particularly, it is understood that an effect of suppressing an increase in valve face temperature increases as the engine rotation speed changes to the high rotation speed. Further, in the assembly No. d of the valve and valve seat insert using the hollow poppet valve and the valve seat insert having high thermal conductivity, it is understood that an increase in valve temperature is remarkably suppressed through a wide range from the low-middle rotation speed to the high rotation speed compared with the assembly No. c of the hollow poppet valve and the standard valve seat insert. Further, in the assembly No. d, it is found that an effect of suppressing an increase in valve temperature is large particularly at the low-middle rotation speed of 1000 to 3500 rpm compared with the assembly No. c.

The invention is completed by a further examination based on such knowledge. That is, the essential of the invention is as below.

(1) An assembly of a valve and a valve seat insert for an internal combustion engine, wherein the valve is formed of a material having thermal conductivity of 5 to 45 (W/m·K) at 20 to 1000° C., the valve comprises a stem and a head integrally formed with the stem at an end of the stem, the valve has a hollow part formed from the head to the stem, and coolant is filled into the hollow part along with an inert gas, and wherein the valve seat insert is formed as a valve seat insert made of iron base sintered alloy and having a double-layer structure obtained by integrating two layers of a supporting material side layer and a valve contact face side layer, the supporting material side layer has thermal conductivity of 23 to 50 (W/m·K) at 20 to 300° C., and the valve contact face side layer has thermal conductivity of 10 to 22 (W/m·K) at 20 to 300° C.

(2) The assembly of the valve and the valve seat insert for the internal combustion engine according to (1), wherein the hollow part of the valve comprises a large-diameter hollow part having a substantial disk shape and provided inside the head and a small-diameter hollow part having a substantially linear shape and provided in the stem, the large-diameter hollow part communicates with the small-diameter hollow part so as to be substantially orthogonal thereto, and an opening peripheral portion of the small-diameter hollow part in the large-diameter hollow part is formed as a plane substantially orthogonal to a center axis line of the valve.

(3) The assembly of the valve and the valve seat insert for the internal combustion engine according to (2), wherein the large-diameter hollow part is formed in a conical trapezoid shape having a tapered outer peripheral face substantially similar to the outer shape of the head.

(4) The assembly of the valve and the valve seat insert for the internal combustion engine according to any one of (1) to (3), wherein the coolant is a material having higher thermal conductivity than the material of the valve.

(5) The assembly of the valve and the valve seat insert for the internal combustion engine according to any one of (1) to (4), wherein the valve is padded on at least a contact area with respect to the valve seat insert on the valve face.

(6) The assembly of the valve and the valve seat insert for the internal combustion engine according to any one of (1) to (5), wherein the material of the valve is one of heat-resistant steel and the equivalent thereof or Ni base alloy and the equivalent thereof.

(7) The assembly of the valve and the valve seat insert for the internal combustion engine according to any one of (1) to (6), wherein the valve seat insert formed of the iron base sintered alloy is formed so that a boundary face between the valve contact face side layer and the supporting material side layer is formed within an area surrounded by a face having an angle of 45° formed with respect to a valve seat insert axis and having a circular line distant by 0.5 mm from a valve contact face toward a supporting material in a direction perpendicular to the valve contact face at a center position of the valve contact face in the width direction and a face having a circular line of ½ of a valve seat insert height as a distance from a valve seat insert seating face on the outer peripheral face of the valve seat insert and an intersection line between the valve seat insert seating face and the inner peripheral face of the valve seat insert.

(8) The assembly of the valve and the valve seat insert for the internal combustion engine according to (7), wherein the valve contact face side layer is 10 to 60% as a volume % with respect to the entire valve seat insert.

(9) The assembly of the valve and the valve seat insert for the internal combustion engine according to (7) or (8), wherein the valve contact face side layer is formed of iron base sintered alloy having a base matrix in which hard particles are dispersed in a base matrix phase, the base matrix has a base matrix composition containing 0.2 to 2.0% of C, 40% or less of one or two or more selected from Co, Mo, Si, Cr, Ni, Mn, W, V, and S in total and the balance being Fe and inevitable impurities by a mass %, and the base matrix has a base matrix structure in which 5 to 40% of the hard particles are dispersed in the base matrix phase with respect to the entire valve contact face side layer by a mass %, and wherein the supporting material side layer is formed of iron base sintered alloy having a base matrix composition containing 0.2 to 2.0% of C and the balance being Fe and inevitable impurities as a rest by a mass %.

(10) The assembly of the valve and the valve seat insert for the internal combustion engine according to (9), wherein the supporting material side layer contains 20% or less of one or two or more selected from Mo, Si, Cr, Ni, Mn, W, V, S, and P in total by a mass % in addition to the base matrix composition.

(11) The assembly of the valve and the valve seat insert for the internal combustion engine according to any one of (7) to (10), wherein the valve contact face side layer has a base matrix structure in which 0.5 to 4% of solid lubricant particles are dispersed in the base matrix phase with respect to the entire valve contact face side layer by a mass % in addition to the base matrix structure.

(12) The assembly of the valve and the valve seat insert for the internal combustion engine according to any one of (7) to (11), wherein the supporting material side layer has a structure in which 0.5 to 4% of solid lubricant particles are dispersed in the base matrix phase with respect to the entire supporting material side layer by a mass %.

Advantageous Effects of Invention

According to the invention, it is possible to provide the assembly of the valve and the valve seat insert capable of suppressing an increase in peripheral temperature of a combustion chamber of an internal combustion engine, particularly, an increase in valve temperature through a wide range of an engine rotation speed compared with the related art. Thus, there is a particular industrial effect in which an internal combustion engine for an automobile has improved output.

Further, according to the invention, there is also an effect in which a valve weight can be decreased due to the hollow part, a friction can be decreased through a decrease in mechanical resistance loss or a decrease in valve spring load, and fuel consumption can be improved. Further, according to the invention, there is also an effect in which the maximal rotation speed of the engine is also improved due to a decrease in weight of the valve.

Further, according to the invention, there is also an effect in which a combustion chamber temperature can be decreased, ignition timing can be advanced due to suppressed knocking, and fuel consumption or torque can be improved. Further, according to the invention, there is also an effect in which knocking can be suppressed, fuel can be compressed highly, and fuel consumption or torque can be improved.

Further, according to the invention, the valve temperature decreases and hence degradation in fatigue strength of the valve can be suppressed. Accordingly, a cheap material having low heat resistance can be also used and hence there is also an effect in which material cost can be economically decreased. Further, according to the invention, since it is possible to suppress an increase in peripheral temperature of the combustion chamber through a decrease in valve temperature, there is an effect that $\lambda 1$ (a theoretical air-fuel ratio) can be increased and fuel consumption can be improved.

DESCRIPTION OF EMBODIMENTS

Figure 1:
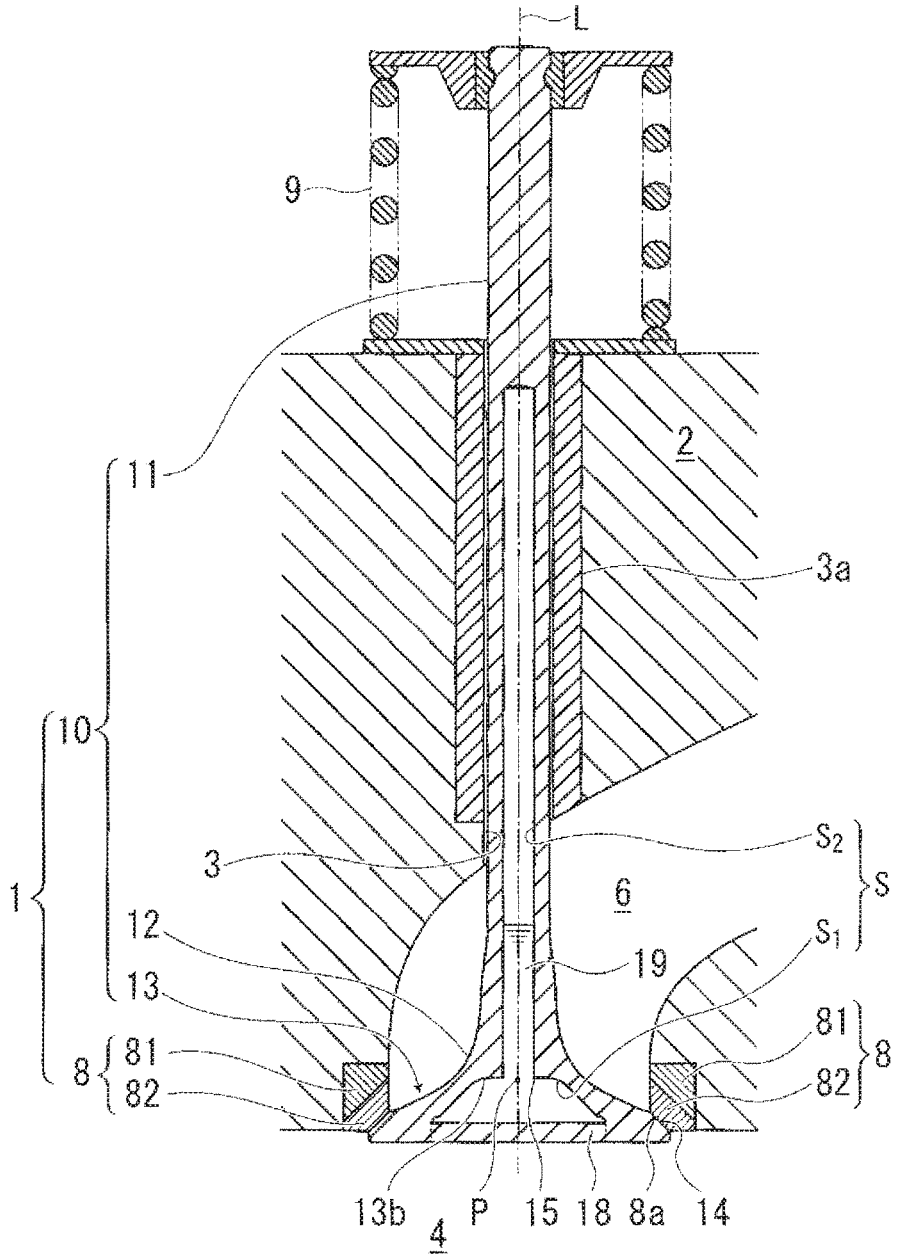
FIG. 1 is a longitudinal sectional view illustrating a shape of a hollow poppet valve used in the invention and a state where the hollow poppet valve is assembled with a valve seat insert and is fitted into a cylinder head.

First, as illustrated in FIG. 1, an assembly 1 of a valve and a valve seat insert of the invention means, for example, an assembly of a valve 10 of which a face part 14 contacts a valve contact face 8*a* of a valve seat insert 8 and the valve seat insert 8 press-fitted into an opening peripheral portion of an exhaust passage 6 toward a combustion chamber 4 at a cylinder head 2 of an internal combustion engine (an engine). Further, Reference Numeral 3 indicates a valve insertion port also provided in the cylinder head 2 and a valve guide 3*a* is disposed on the inner periphery thereof. Further, Reference Numeral 9 indicates a spring that energizes the valve 10 in a valve opening direction.

First, a valve used herein will be described.

In the assembly 1 of the valve and the valve seat insert of the invention, the hollow poppet valve (the hollow valve) 10 in which a head 13 is integrally formed with an end of a stem 11, a hollow part S is formed from the head to a stem, and coolant 19 is filled into the hollow part S along with an inert gas, is used.

In the hollow poppet valve 10, the tapered face part 14 is provided in an outer periphery of a head 13 in the valve in which the head 13 is integrally formed with one end side of a stem 11 through an R-shaped fillet part 12 having a gradually increasing outer diameter. Coolant 19 is filled (enclosed) in the hollow part S along with an inert gas such as an argon gas. As the coolant (the refrigerant), it is desirable to use a material, for example, metallic sodium or metallic potassium having higher thermal conductivity than a valve material from the viewpoint of the heat transfer effect. Further, it is desirable that the amount of the enclosed coolant be 50% or more of the volume of the hollow part.

The hollow poppet valve used in the invention is set to a valve formed of a material of which the thermal conductivity is 5 to 45 (W/m·K) from 20 to 1000° C.

As the valve material having such thermal conductivity, one of heat-resistant steel and the equivalent or Ni-base super alloy and the equivalent is desirable.

As the heat-resistant steel, martensite-type or austenite-type heat-resistant steel defined in JIS G 4311 can be exemplified. Among the heat-resistant steel defined in JIS G 4311, austenite-type heat-resistant steel is desirable from the viewpoint of heat resistance strength.

Further, as the Ni-base super alloy, Inconel 751, Nimonic 80 A, or the like can be exemplified.

Figure 2:
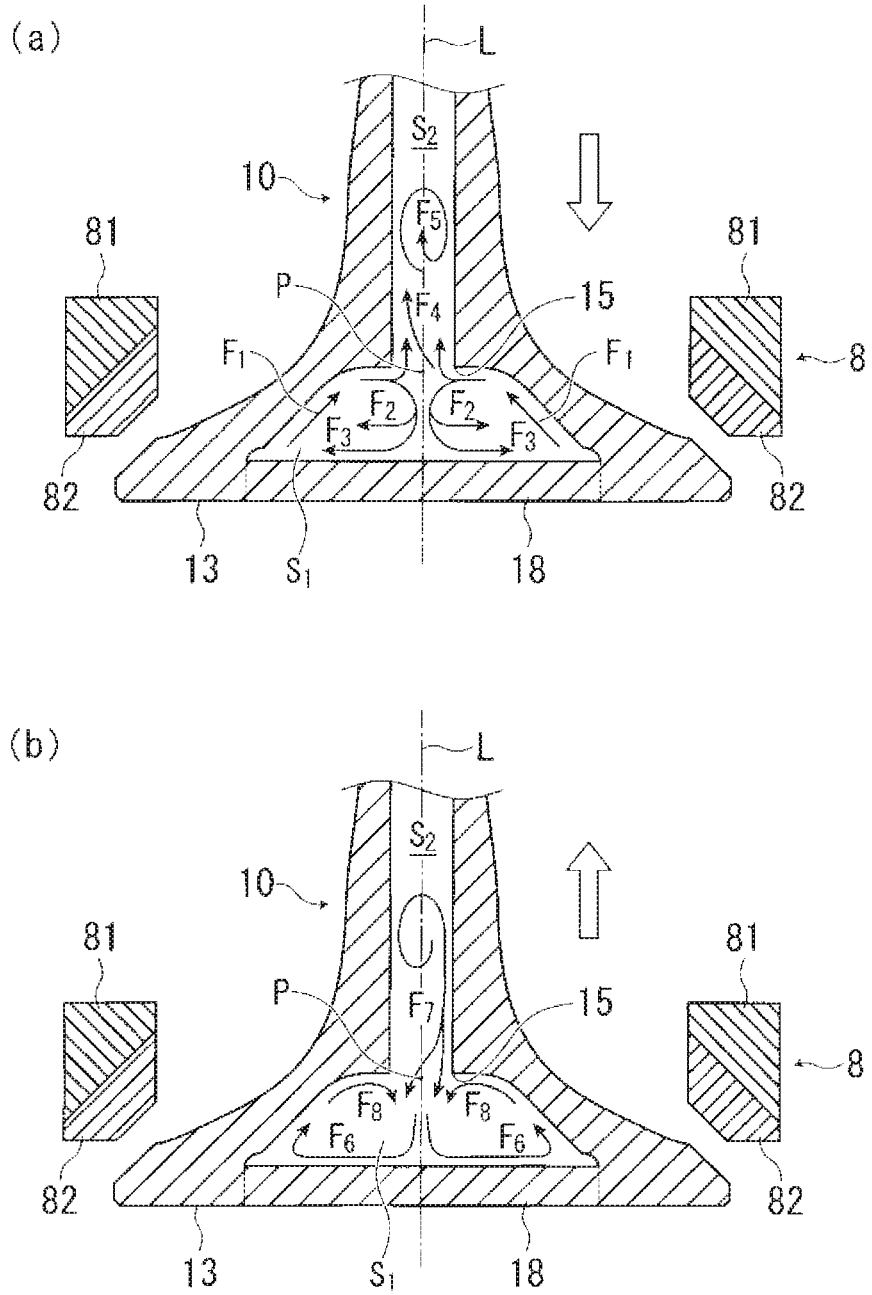
FIGS. 2(*a*) and 2(*b*) are explanatory views schematically illustrating a flow of coolant inside a hollow part when the hollow poppet valve used in the invention is opened and closed.

As illustrated in FIG. 1, the hollow valve 10 used in the invention is desirably formed as a valve in which a hollow part S comprises a large-diameter hollow part S1 which has a substantial disk shape and is provided inside the head 13 and a small-diameter hollow part S2 which has a substantial linear shape and is provided in the stem 11, the large-diameter hollow part S1 and the small-diameter hollow part S2 communicate with each so as to be substantially orthogonal to each other, and the opening peripheral portion of the small-diameter hollow part S2 in the large-diameter hollow part S1 is formed as a plane 13*b* substantially orthogonal to the center axis line L of the valve. That is, an eave-shaped annular step part 15 is formed by the inner peripheral face of the small-diameter hollow part S2 and the opening peripheral portion of the small-diameter hollow part S2. By the existence of the annular step part 15, a circulation of coolant inside the hollow part S occurs so as to rotate inwardly in the longitudinal direction as indicated by the arrow of FIGS. 2(*a*) and 2(*b*) and a turbulent flow of coolant inside the small-diameter hollow part S2 also occurs when the valve is opened and closed. Accordingly, the upper layer part to the lower layer part of the coolant 19 inside the hollow part S are actively mixed and hence the heat transfer effect of the valve is further improved. Further, FIG. 2(*a*) indicates a case where the valve moves down and FIG. 2(*b*) indicates a case where the valve moves up.

Further, it is desirable that the large-diameter hollow part S1 is formed in a conical trapezoid shape having a tapered outer peripheral face substantially similar to the outer shape of the head 13. Accordingly, the volume of the large-diameter hollow part S1 can be increased and hence a large amount of coolant can be charged. Further, since the conical upper face and the conical outer peripheral face form an obtuse angle, coolant smoothly flows (like F1, F2, F6, and F8 of FIGS. 2(*a*) and 2(*b*)) so as to activate the circulation when the valve is opened and closed and hence the heat transfer effect of the valve is further improved.

Figure 3:
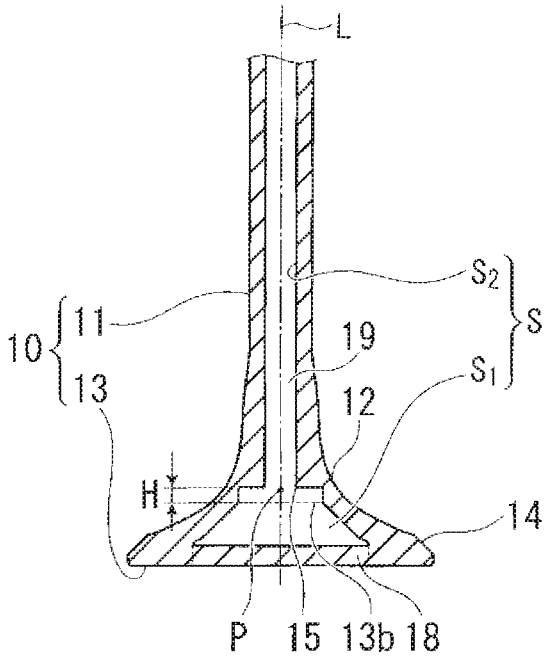
FIG. 3 is a longitudinal sectional view illustrating another example of the hollow poppet valve used in the invention.

Further, as illustrated in FIG. 3, the large-diameter hollow part S1 may be formed in a substantially conical trapezoid shape in which a ceiling face 13*b* is offset from the above-described conical upper face toward the stem of the valve by a predetermined amount H. Accordingly, the amount of the filled coolant can be increased.

Further, in the hollow poppet valve used in the invention, padding may be performed on a contact area (a face plane) with respect to the valve seat insert by welding or the like for the purpose of improving wear resistance, corrosion resistance, and the like. As the material of padding, Co—Cr—Mo—C-type alloy represented as stellite (trade mark) or Co-based face hardened alloy such as Co—Mo—Si-type alloy represented as TRIBALLOY (trade mark) can be exemplified.

In addition, it is needless to limit the manufacturing method of the hollow poppet valve having the above-described structure used in the invention particularly as long as a manufacturing method capable of forming the above-described structure.

The hollow poppet valve used in the invention may be formed a predetermined dimension shape by general processing such as cutting and grinding while a casting material, a forging material, or a rolling material having a predetermined composition are used as the valve material. However, in the hollow poppet valve used in the invention, it is desirable to use, for example, the following steps of the manufacturing method from the viewpoint of improving the productivity.

That is, it is desirable to manufacture the hollow poppet valve having a structure illustrated in FIG. 1 from a valve material by sequentially performing a forming step of forming a concave part corresponding to a large-diameter hollow part at the inside of a head outer shell by, for example, forging using a mold, a hole drilling step of drilling a hole corresponding to a small-diameter hollow part in a bottom face of the concave part, a coolant filling step of filling a predetermined amount of coolant (solid) into the concave part corresponding to the large-diameter hollow part, and a hollow part sealing step of sealing the hollow part by welding a cap to an opening of the concave part under the atmosphere of an inert gas. However, it is needless to mention that a method of manufacturing the hollow poppet valve used in the invention is not limited thereto.

Next, the valve seat insert used in the assembly of the invention will be described.

The valve seat insert 8 used in the invention is a valve seat insert formed of iron base sintered alloy. The valve seat insert 8 which comprises a supporting material side layer 81 provided at a contact side with respect to a seat face of the cylinder head 2 and a valve contact face side layer 82 provided at a contact side with respect to the valve 10, has a double-layer structure in which two layers, that is, the supporting material side layer 81 and the valve contact face side layer 82 are integrated with each other as illustrated in FIG. 1.

Further, the valve seat insert used in the invention is set as a valve seat insert in which the thermal conductivity measured at 20 to 300° C. by a laser flash method satisfies 23 to 50 W/m·K at the supporting material side layer and 10 to 22 W/m·K at the valve contact face side layer.

When the thermal conductivity of the supporting material side layer is smaller than 23 W/m·K, desired high thermal conductivity can be ensured. For this reason, the thermal conductivity of the supporting material side layer is set to 23 W/m·K or more. Further, when the supporting material side layer has a composition so that the thermal conductivity exceeds 50 W/m·K, the strength needs to be improved separately and the productivity is degraded. Further, when the thermal conductivity of the valve contact face side layer is smaller than 10 W/m·K, the content of alloy increases and hence desired strength cannot be ensured. Meanwhile, when the valve contact face side layer has a composition so that the thermal conductivity exceeds 22 W/m·K, desired wear resistance cannot be ensured.

In the invention, as the valve seat insert assembled with the hollow valve having the above-described structure, an iron base sintered alloy valve seat insert having a double-layer structure and satisfying the thermal conductivity of the valve seat insert used in the related art can be appropriately used.

Further, in the invention, it is desirable to use the hollow poppet valve having the above-described structure by assembling particularly a high thermal conduction type valve seat insert having high thermal conductivity with the hollow poppet valve. In the assembling of the valve and the valve seat insert, the heat transfer effect of the assembly of the valve and the valve seat insert is remarkably improved in addition to the heat transfer effect of the valve. Particularly, the heat transfer effect at the low-middle rotation speed zone of the engine is remarkably improved.

Figure 4:
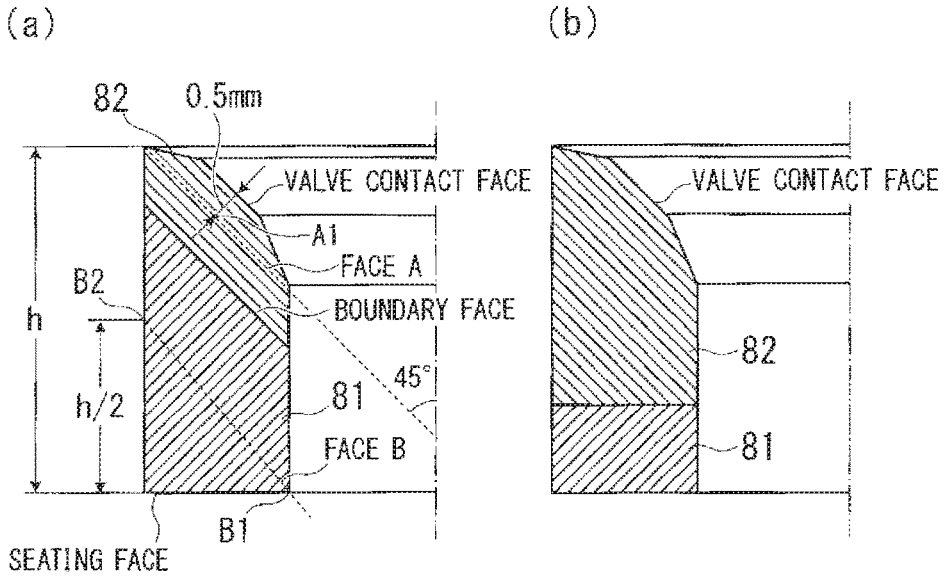
FIGS. 4(*a*) and 4(*b*) are explanatory views schematically a shape of the valve seat insert used in the invention, where FIG. 4(*a*) is a high thermal conduction type and FIG. 4(*b*) is a standard type.

For the high thermal conduction type valve seat insert having high thermal conductivity, the valve contact face side layer having a large content of alloy and low thermal conductivity is formed as thin as possible, the supporting material side layer having a small content of alloy and excellent thermal conductivity is formed so as to be thick, and the contact face between the cylinder head and the supporting material side layer of the valve seat insert is enlarged. For that reason, in the high thermal conduction type valve seat insert used in the invention, as illustrated in FIG. 4(*a*), it is assumed that a boundary face between the valve contact face side layer 82 and the supporting material side layer 81 is formed within an area surrounded by a face (a face A) which includes a circular line (A1) distant from the valve contact face toward the supporting material by 0.5 mm in a direction perpendicular to the valve contact face at the center position of the valve contact face in the width direction and forms an angle of 45° with respect to the valve seat insert axis and a face (a face B) which has an intersection line (B1) between the valve seat insert seating face and the inner peripheral face of the valve seat insert and a circular line (B2) having a distance from the valve seat insert seating face on the outer peripheral face of the valve seat insert set to ½ of the valve seat insert height h. FIG. 4(*a*) is a longitudinal sectional view schematically illustrating a shape of the high thermal conduction type valve seat insert. Further, in FIG. 4(*b*) illustrates a shape of the standard valve seat insert used in general. In the standard valve seat insert, the boundary face is set a face forming an angle of 90° with respect to a valve seat insert axis.

Regarding the boundary face between the valve contact face side layer and the supporting material side layer, the valve contact face side layer is thin too much at the valve contact face in relation to the above-described face (the face A) and hence the durability of the valve seat insert is degraded. From the viewpoint of the durability, it is more desirable that the boundary face is located at a position of 1 mm or more near the supporting material from the valve contact face in a direction perpendicular to the valve contact face at the center position of the valve contact face in the width direction.

Furthermore, when the boundary face is near the supporting material in relation to the above-described face (the face B), the valve contact face side layer is thickened too much and hence the thermal conductivity of the valve seat insert is degraded. In order to maximally increase the contact area between the supporting material side layer and the cylinder head, it is desirable to adjust the boundary face between the valve contact face side layer and the supporting material side layer as a face having a circular line and formed so that an angle $\alpha$ formed with respect to the valve seat insert axis is 60° or less and desirably 40 to 50° and a distance from the valve seat insert seating face on the outer peripheral face of the valve seat insert is ½ or more of the valve seat insert height h and is desirably ¾ or more.

Regarding the manufacturing of the above-described high thermal conduction type valve seat insert, the balance between the molding pressure and the molding face shape of the provisional pressing punch when mixed powder for the supporting material side layer is provisionally pressed and the adjustment of the molding pressure of the punch obtained when mixed powder for the valve contact face side layer is compressed are important when a desired boundary face is stably formed. Specifically, it is desirable to adjust the molding face shape of the provisional pressing punch so that an angle with respect to the axis is set to 20 to 50° and the molding pressure of the provisional pressing punch is 0.01 to 3 ton/cm$^2$.

When the angle of the molding face shape of the provisional pressing punch with respect to the axis exceeds 50°, desired high thermal conductivity cannot be ensured. Meanwhile, when the angle of the molding face shape of the provisional pressing punch with respect to the axis is smaller than 20°, powder moves too much in a molding process and hence a desired boundary face shape cannot be molded. Further, when the molding pressure of the provisional pressing punch is smaller than 0.01 ton/cm$^2$, the boundary face changes in the circumferential direction or the radial direction and hence desired boundary face precision cannot be ensured. Meanwhile, when the molding pressure of the provisional pressing punch increases so as to exceed 3 ton/cm$^2$, the adhesion between the supporting material side layer and the valve contact face side layer decreases and hence the strength of the valve seat insert decreases. Due to this reason, the molding face shape of the provisional pressing punch is adjusted so that an angle with respect to the axis is 20 to 50° and the molding pressure of the provisional pressing punch is adjusted in the range of 0.01 to 3 ton/cm$^2$.

Further, in the high thermal conduction type valve seat insert used in the invention, the boundary face is adjusted within the above-described range and desirably the valve contact face side layer is adjusted so that the volume % with respect to the entire valve seat insert is 10 to 60%. When the volume % of the valve contact face side layer with respect to the entire valve seat insert is smaller than 10%, the valve contact face side layer is thin and durability is not sufficient. Meanwhile, when the volume exceeds 60%, the valve contact face side layer is thickened too much and hence thermal conductivity is degraded.

Further, in the standard valve seat insert used in the invention, it is desirable to adjust the boundary face so that an angle with respect to the valve seat insert axis is set to 90° and the volume % of the valve contact face side layer with respect to the entire valve seat insert is 40 to 60%.

The valve contact face side layer of the valve seat insert used in the invention is formed of iron base sintered alloy having base matrix in which hard particles are dispersed in a base matrix phase. When the hard particles are dispersed in the base matrix phase, the wear resistance of the valve seat insert is remarkably improved. As the hard particles dispersed in the base matrix phase, Co-base intermetallic compound particles are desirable. The Co-base intermetallic compound particles have a feature that intermetallic compound having high hardness is dispersed in a comparatively soft Co base matrix and opposite material aggressiveness is low. Further, as desirable Co-base intermetallic compound particles, Si—Cr—Mo-type Co-base intermetallic compound particles and Mo—Ni—Cr-type Co-base intermetallic compound particles can be exemplified.

In the valve contact face side layer, it is desirable to disperse hard particles by 5 to 40% by a mass % with respect to the entire valve contact face side layer. When the hard particle dispersion amount is smaller than 5%, desired wear resistance cannot be ensured. Meanwhile, even when a large amount of hard particles are dispersed so as to exceed 40%, the effect is saturated and hence an effect matching an addition amount cannot be expected. For this reason, it is desirable that the hard particle dispersion amount in the valve contact face side layer is 5 to 40% by a mass % with respect to the entire valve contact face side layer. More desirably, the mass % is 20 to 30%.

Further, 0.5 to 4% of solid lubricant particles may be contained in the valve contact face side layer by a mass % with respect to the entire valve contact face side layer in addition to the above-described hard particles. When the content is smaller than 0.5%, a desired lubricating effect cannot be expected and hence machinability is degraded. Meanwhile, when the content exceeds 4%, the effect is saturated and hence the strength is degraded. For this reason, it is desirable to limit the content in the range of 0.5 to 4%. As the solid lubricant particles, MnS and $CaF_2$ can be exemplified.

In the valve contact face side layer, it is desirable that the base matrix comprising the base matrix phase, the hard particles, and/or the solid lubricant particles have a base matrix composition containing 0.2 to 2.0% of C, 40% or less of one or two or more selected from Co, Mo, Si, Cr, Ni, Mn, W, V, and S in total and the balance being Fe and inevitable impurities by a mass %.

C: 0.2 to 2.0%

C is an element that improves the strength and the hardness of the sintered body and easily diffuses a metallic element in a sintering process and is desirably contained by 0.2% or more in order to obtain such an effect. Meanwhile, when the content exceeds 2.0%, cementite is easily generated inside a base matrix, a liquid phase is easily generated in a sintering process, and dimensional precision is degraded. For this reason, it is desirable to limit C in the range of 0.2 to 2.0%. Further, the range is desirably from 0.7 to 1.3%.

One or Two or More Selected from Co, Mo, Si, Cr, Ni, Mn, W, V, and S: 40% or Less in Total Co, Mo, Si, Cr, Ni, Mn, W, V, and S are all elements which improve the strength and the hardness of the sintered body and improve the wear resistance thereof. In order to obtain such an effect, it is desirable to contain at least one of the elements including hard particles by 5% or more in total. Meanwhile, when the content exceeds 40% in total, formability and strength are degraded. For this reason, it is desirable that one or two or more selected from Co, Mo, Si, Cr, Ni, Mn, W, V, and S are limited to 40% or less in total. Desirably, the content is 30% or less in total.

The rest of the valve contact face side layer other than the above-described examples consists of Fe and inevitable impurities.

Meanwhile, the supporting material side layer of the valve seat insert used in the invention is formed of iron base sintered alloy and is integrated with the valve contact face side layer through the boundary face. It is desirable that the supporting material side layer have a composition capable of ensuring desired strength as the valve seat insert while supporting the contact face side layer without contacting the valve.

Further, the supporting material side layer may contain 0.5 to 4% of solid lubricant particles in the base matrix with respect to the entire supporting material side layer by a mass % if necessary. When the content is smaller than 0.5%, a desired lubricating effect cannot be expected and hence machinability is degraded. Meanwhile, when the content exceeds 4%, the effect is saturated and hence the strength is degraded. For this reason, it is desirable to limit the content in the range of 0.5 to 4%. As the solid lubricant particle, MnS and $CaF_2$ can be exemplified. More desirably, the content is 0.5 to 3%.

The base matrix phase composition (the base matrix composition including solid lubricant particles when the solid lubricant particles are dispersed) of the supporting material side layer of the valve seat insert used in the invention contains 0.2 to 2.0% of C, 20% or less of one or two or more selected from Mo, Si, Cr, Ni, Mn, W, V, S, and P in total and the balance being Fe and inevitable impurities by a mass %.

C: 0.2 to 2.0%

C is an element which improves the strength and the hardness of the sintered body and is desirably contained by 0.2% or more in order to ensure the desired strength and the desired hardness as the valve seat insert. Meanwhile, when the content exceeds 2.0%, cementite is easily generated inside a base matrix phase, a liquid phase is easily generated in a sintering process, and dimensional precision is degraded. For this reason, it is desirable to limit C in the range of 0.2 to 2.0%. More desirably, the range is 0.7 to 1.3%.

The above-described elements are basic elements of the supporting material side layer, but may further contain one or two or more selected from Mo, Si, Cr, Ni, Mn, W, V, S, and P by 20% or less in total in addition to the basic composition.

One or Two or More Selected from Mo, Si, Cr, Ni, Mn, W, V, S, and P: 20% or Less in Total Mo, Si, Cr, Ni, Mn, W, V, S, P are all elements which improve the strength and the hardness of the sintered body and one or two or more thereof can be contained if necessary. In order to obtain such an effect, the content of 5% or more in total is desirable, but the content needs to be decreased as small as possible from the viewpoint of the thermal conductivity. Meanwhile, when the content exceeds 20% in total, formability is degraded. For this reason, it is desirable to limit the content of one or two or more selected from Mo, Si, Cr, Ni, Mn, W, V, S, and P to 20% or less in total.

The rest of the supporting material side layer other than the above-described examples consists of Fe and inevitable impurities.

Further, it is important that the supporting material side layer is a layer having high thermal conductivity in which the thermal conductivity measured at 20 to 300° C. by a laser flash method is 23 (W/m·K) or more. For that reason, it is desirable to form the supporting material side layer by iron base sintered alloy having a base matrix composition containing 0.2 to 2.0% of C and the balance being Fe and inevitable impurities by a mass % so that a particularly expensive alloy element does not need to be contained even within the above-described composition range.

Next, a desirable method of manufacturing the valve seat insert used in the invention by iron base sintered alloy will be described.

It is desirable to mold the valve seat insert made of iron base sintered alloy and used in the invention by a press-molding machine having a die, a core rod, an upper punch, a lower punch, two kinds of separately driven feeders, and an independently driven provisional pressing punch.

First, as the raw material powder for the supporting material side layer, iron-based powder, graphite powder, alloy powder as the other alloy element powder, lubricant particle powder, and/or solid lubricant particle powder are blended and mixed by a predetermined amount so as to obtain the above-described desired supporting material side layer composition and are kneaded so as to obtain mixed powder for the supporting material side layer.

As the raw material powder for the valve contact face side layer, iron-based powder, graphite powder, alloy powder as the other alloy element powder, hard particle powder, lubricant particle powder, and/or solid lubricant particle powder are blended mixed by a predetermined amount so as to obtain the above-described desired valve contact face side layer composition and are kneaded so as to obtain mixed powder for the valve contact face side layer.

The mixed powder for the supporting material side layer is charged into a first feeder and the mixed powder for the valve contact face side layer is charged into a second feeder. First, after the first feeder is moved, the die and the core rod are relatively moved up with respect to the lower punch, and the mixed powder for the supporting material side layer is charged into a charging space for the supporting material side layer while the charging space is formed. Then, the provisional pressing punch is moved, the molding face shape and the molding pressure of the provisional pressing punch are adjusted so that an upper face as the boundary face with respect to the valve contact face side layer is formed in a predetermined shape, and the mixed powder for the supporting material side layer is provisionally pressed.

In order to manufacture the high thermal conduction type valve seat insert used in the invention, it is desirable to perform a provisional pressing operation so that the molding face shape of the provisional pressing punch is formed in a shape in which an angle with respect to the valve seat insert axis becomes 20 to 40% smaller than the angle of the boundary face of the obtained green compact and the molding pressure of the provisional pressing operation becomes 0.01 to 3 ton/cm$^2$.

Next, after the second feeder is moved, the die and the core rod are relatively moved with respect to the lower punch, and the mixed powder for the valve contact face side layer is charged into a charging space for the valve contact face side layer while the charging space is formed. Then, the upper punch is moved down and the mixed powder for the valve contact face side layer and the mixed powder for the supporting material side layer are integrally pressed so as to obtain a green compact. When the mixed powder for the valve contact face side layer and the mixed powder for the supporting material side layer are integrally pressed, it is desirable to adjust the molding pressure so that the green compact density is in the range of 6.5 to 7.5 g/cm$^3$.

Next, the obtained green compact is heated and sintered at 1100 to 1200° C. under the protection atmosphere of an ammonia decomposing gas and vacuum by a general sintering method so as to obtain a sintered body. The sintered body obtained in this way is formed as a valve seat insert for an internal combustion engine having a predetermined dimensional shape by processing such as cutting and grinding.

EXAMPLES

Figure 8:
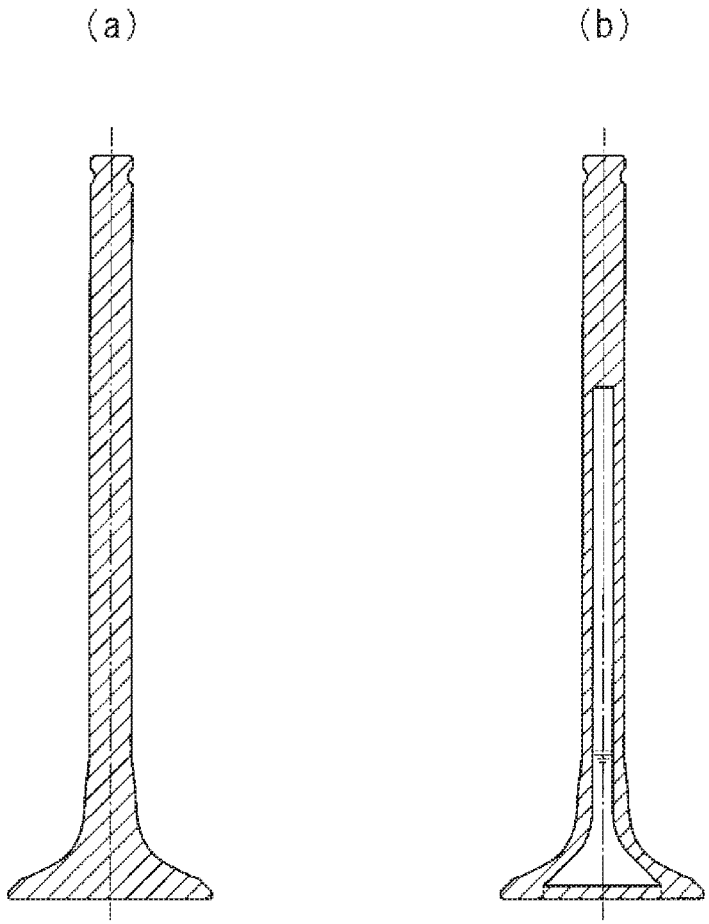
FIGS. 8(*a*) and 8(*b*) are longitudinal sectional views illustrating a shape of a valve used as comparison.

A valve material was set as austenite-type heat-resistant steel SUH35 (having thermal conductivity of 18 W/m·K at 20° C.) and the valve material was sequentially subjected to a forging step, a hole drilling step, a coolant filling step, and a hollow part sealing step so as to manufacture a hollow poppet valve having a structure illustrated in FIG. 1. Further, coolant filled into a hollow part was set as metallic sodium (having thermal conductivity of 142 W/m·K at 0° C.). Further, the valve material was subjected to cutting and polishing so as to manufacture a solid valve having a structure illustrated in FIG. 8(*a*).

Further, raw material powder was blended, mixed, and kneaded so as to have a sintered body composition and a sintered body structure of a valve seat insert illustrated in Table 2, thereby obtaining mixed powder for a valve contact face side layer and mixed powder for a supporting material side layer. The mixed powder was compression-molded by a press-molding machine having a die, a core rod, an upper punch, a lower punch, two kinds of separately driven feeders, and an independently driven provisional pressing punch so as to obtain a green compact having a double-layer structure and was subjected to a sintering process so as to obtain a sintered body. The obtained sintered body was subjected to cutting, grinding, or the like so as to obtain a valve seat insert for an internal combustion engine formed of iron base sintered alloy and having a double-layer structure comprising a valve contact face side layer and a supporting material side layer with a predetermined dimensional shape (having an outer diameter of 30 mmϕ, an inner diameter of 25 mmϕ, and a height of 6 mm). The obtained valve seat insert corresponds to a high thermal conduction type valve seat insert having a structure illustrated in FIG. 5(*a*) and a standard valve seat insert having a structure illustrated in FIG. 5(*b*).

Figure 5:
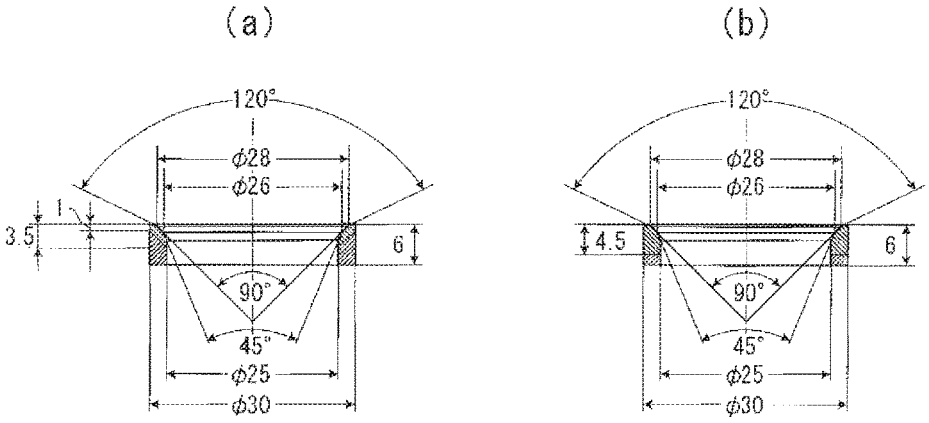
FIGS. 5(*a*) and 5(*b*) are longitudinal sectional views illustrating an example of a shape of the valve seat insert used in the invention, where FIG. 5(*a*) is a high thermal conduction type and FIG. 5(*b*) is a standard type.
Figure 6:
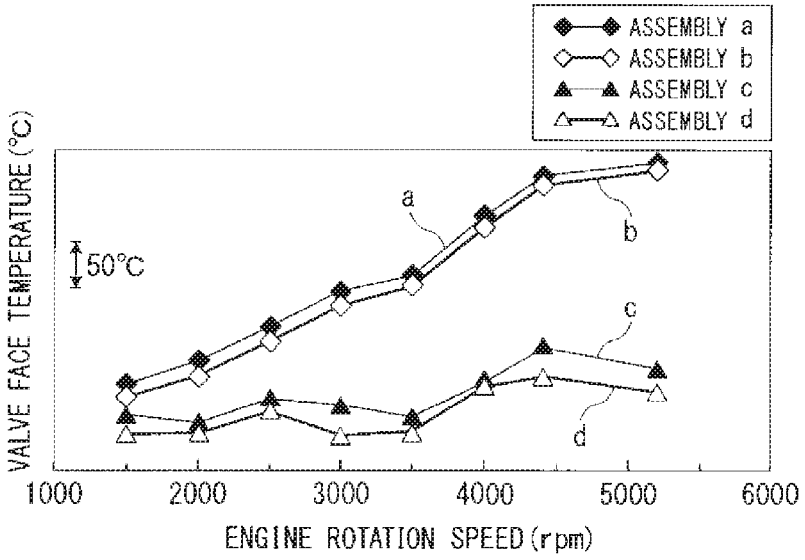
FIG. 6 is a graph showing an influence of an assembly of the valve and the valve seat insert on a relation between a valve face temperature and an engine rotation speed.

Further, in the high thermal conduction type valve seat insert having a structure illustrated in FIG. 5(*a*), the boundary face between the valve contact face side layer and the supporting material side layer is a face that includes a circular line of 5 mm from the valve seat insert seating face at the outer peripheral face of the valve seat insert and a circular line of 2.5 mm from the seat face at the inner peripheral face of the valve seat insert and an angle formed with respect to the valve seat insert axis is 45°. Further, the boundary face is a face distant by 1.0 mm in a direction perpendicular to the valve contact face at the center position of the valve contact face in the width direction. The boundary face is within an area surrounded by a face having a circular line of 0.5 mm in a direction perpendicular to the valve contact face at the center position of the valve contact face in the width direction and forming an angle of 45° with respect to the valve seat insert axis and a face having a circular line of ½ of the valve seat insert height as a distance from the upper end face of the valve seat insert on the outer peripheral face of the valve seat insert and an intersection line between the valve seat insert seating face and the inner peripheral face of the valve seat insert.

Further, in the high thermal conduction type valve seat insert having a structure illustrated in FIG. 5(*a*), the thermal conductivity at 20 to 300° C. was 13 W/m·K at the valve contact face side layer and was 37 W/m·K at the supporting material side layer. In the standard valve seat insert having a structure illustrated in FIG. 5(*b*), the thermal conductivity at 20 to 300° C. was 13 W/m·K at the valve contact face side layer and was 37 W/m·K at the supporting material side layer.

Further, in the high thermal conduction type valve seat insert, the molding process was performed while the molding face shape of the provisional pressing punch in the powder compression-molding process was adjusted to so as to have an angle of 25 to 40° with respect to the axis and the molding pressure of the provisional pressing punch was adjusted in the range of 0.02 to 1 ton/cm$^2$. In the process of manufacturing the standard valve seat insert, the molding face shape of the provisional pressing punch was set to be flat (an angle of 90° with respect to the axis).

Figure 7:
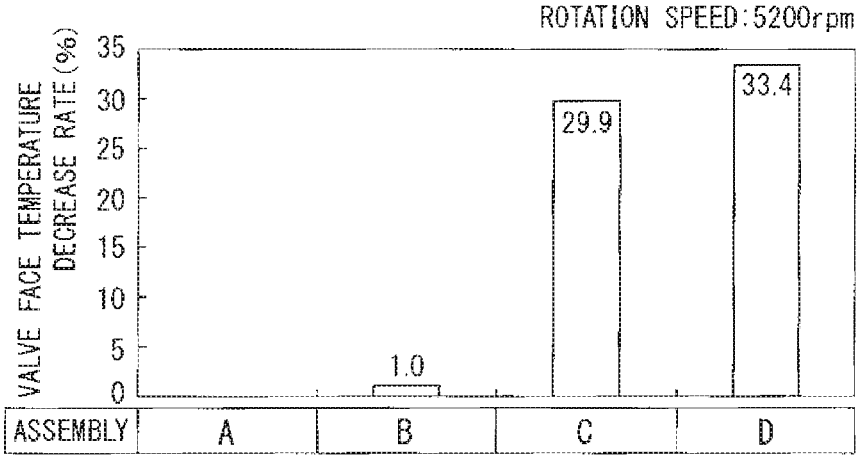
FIG. 7 is a graph showing an influence of an assembly of the valve and the valve seat insert on a valve face temperature decrease rate.

From FIG. 7, the assembly (the assembly Nos. C and D) of the valve and the valve seat insert of the invention is formed as the assembly of the valve and the valve seat insert in which the valve temperature decreases largely and an increase in valve temperature can be suppressed remarkably compared with the reference assembly (No. A).

TABLE 1

| | | SINTERED BODY COMPOSITION (MASS %) | | | | | | | | | | | | | |
|---|---|---|---|---|---|---|---|---|---|---|---|---|---|---|---|
| | | | | | | | | | | | SUPPORT MATERIAL SIDE LAYER (BASE MATRIX) | | | | |
| VALVE SEAT INSERT No. | VALVE SEAT INSERT TYPE | VALVE CONTACT FACE SIDE LAYER (BASE MATRIX) | | | | | | | | | | | OTHERS Mo, Si, Cr, Ni, Mn, W, V,, S, P | | |
| | | | OTHERS | | | | | | | SUM OF | | | | SUM OF | |
| | | C | Co | Mo | Si | Cr | Ni | Mn | W, V, S | OTHERS | REST | C | | OTHERS | REST |
| Sa | STANDARD TYPE** | 1.1 | 14.1 | 6.2 | 0.6 | 2.1 | 2.0 | 0.6 | W: 0.6, V: 0.2, S: 0.4 | 26.8 | Fe | 1.00 | Mn: 0.3, S: 0.2 | 0.5 | Fe |
| Sb | HIGH THERMAL CONDUCTION TYPE* | 1.1 | 14.1 | 6.2 | 0.6 | 2.1 | 2.0 | 0.6 | W: 0.6, V: 0.2, S: 0.4 | 26.8 | Fe | 1.00 | Mn: 0.3, S: 0.2 | 0.5 | Fe |

| | SINTERED BODY STRUCTURE | | | | | |
|---|---|---|---|---|---|---|
| | | | | | SUPPORT MATERIAL SIDE LAYER (BASE MATRIX) | |
| | VALVE SEAT INSERT No. | VALVE CONTACT FACE SIDE LAYER | | | | |
| | | HARD PARTICLES*** (MASS %) | SOLID LUBRICANT**** (MASS %) | THERMAL CONDUC-TIVITY***** | RATIO****** | SOLID LUBRICANT**** (MASS %) | THERMAL CONDUC-TIVITY***** |
| | Sa | I: 20 | i: 1.0 | 13 | 51 | i: 0.5 | 37 |
| | Sb | I: 20 | i: 1.0 | 13 | 26 | i: 0.5 | 37 |

*FIG. 5(a)
**FIG. 5(b)
***HARD PARTICLES (I): Co-Mo-Si-TYPE Co-BASE INTERMETALLIC COMPOUND PARTICLE
****SOLID LUBRICANT PARTICLES (i): MnS
*****THERMAL CONDUCTIVITY AT 300° C. MEASURED BY LASER FLASH METHOD
******VALVE CONTACT FACE SIDE LAYER RATIO (VOLUME %): VOLUME % WITH RESPECT TO ENTIRE VALVE SEAT INSERT

By assembling the above-described valve and the above-described valve seat insert, the assembly of the valve and the valve seat insert was obtained. The assembly was set as an assembly (A) of a solid valve (No. Ba) and a standard valve seat insert (No. Sa), an assembly (B) of a solid valve (No. Ba) and a high thermal conduction type valve seat insert (No. Sb), an assembly (C) of a hollow valve (No. Bb) and a standard valve seat insert (No. Sa), and an assembly (D) of a hollow valve (No. Bb) and a high thermal conduction type valve seat insert (No. Sb).

The assembly of the valve and the valve seat insert was assembled to a gasoline engine (having a capacity of 1.8 liter and an in-line four cylinder) for an automobile. Further, a thermocouple was welded at the neck part of the valve so as to measure the valve face temperature.

After a heating operation was performed for a predetermined time, a high-load operation was performed at a predetermined rotation speed under predetermined operation condition, and the valve face temperature was measured. The predetermined rotation speed was set to 1000 to 5500 rpm.

The obtained result is illustrated in FIG. 7 by calculating the valve face temperature decrease rate of each assembly (={(the valve face temperature of the reference assembly)−(the valve face temperature of the said assembly)}/(the valve face temperature of the reference assembly)) based on the assembly No. A.

REFERENCE SIGNS LIST

1: assembly of valve and valve seat insert
2: cylinder head
4: combustion chamber
6: exhaust passage
8: valve seat insert
9: valve spring
10: valve
11: stem
12: fillet area
13: head
15: annular step part
18: cap
19: coolant
S: hollow part

The invention claimed is:

1. An assembly comprising:

a valve; and a valve seat insert for an internal combustion engine, wherein the valve is comprised of a material having thermal conductivity of 5 to 45 (W/m·K) at 20 to 1000° C., the valve comprises a stem and a head integral at an end of the stem, the valve has a hollow part formed from the head to the stem, and the hollow part is filled with a coolant and an inert gas, and wherein the valve seat insert has a double-layer structure comprised of a supporting material side layer and a valve contact face side layer, the supporting material side layer has thermal conductivity of 23 to 50 (W/m·K) at 20 to 300° C., and the valve contact face side layer has thermal conductivity of 10 to 22 (W/m·K) at 20 to 300° C., the supporting material side layer and the valve contact face side layer each being an iron base sintered alloy, wherein the hollow part of the valve comprises i) a large-diameter hollow part provided inside the head, the large-diameter hollow part having an overall substantial disk shape with an upper surface and a lower surface, ii) a small-diameter hollow part provided in the stem, the small-diameter hollow part having a substantially linear shape, and iii) an opening between the large-diameter hollow part and the small-diameter hollow part, wherein the large-diameter hollow part communicates with the small-diameter hollow part through the opening, the large-diameter hollow part being substantially orthogonal to the small-diameter hollow part, wherein the opening between the large-diameter hollow part and the small-diameter hollow part is located along a top planar portion of the upper surface of the large-diameter hollow part, the top planar portion being in a plane substantially orthogonal to a center axis line of the valve, wherein the upper surface includes an eave-shaped annular step part located around the top planar portion, wherein the large-diameter hollow part has an overall conical trapezoid shape having a tapered outer peripheral face substantially similar to the outer shape of the head, wherein the material of the valve is one of heat-resistant steel and the equivalent thereof or Ni base alloy and the equivalent thereof, wherein the valve seat insert formed of the iron base sintered alloy is formed so that a boundary face between the valve contact face side layer and the supporting material side layer is formed within an area surrounded by a face having an angle of 45° formed with respect to a valve seat insert axis and having a circular line distant by 0.5 mm from a valve contact face toward a supporting material in a direction perpendicular to the valve contact face at a center position of the valve contact face in the width direction and a face having a circular line of ½ of a valve seat insert height as a distance from a valve seat insert seating face on the outer peripheral face of the valve seat insert and an intersection line between the valve seat insert seating face and the inner peripheral face of the valve seat insert, wherein the valve contact face side layer is 10 to 60% as a volume % with respect to the entire valve seat insert, wherein the valve contact face side layer is formed of iron base sintered alloy having a base matrix in which hard particles are dispersed in a base matrix phase, the base matrix has a base matrix composition containing 0.2 to 2.0% of C, 40% or less of one or two or more selected from Co, Mo, Si, Cr, Ni, Mn, W, V, and S in total and the balance being Fe and inevitable impurities by a mass %, and the base matrix has a base matrix structure in which 5 to 40% of the hard particles are dispersed in the base matrix phase with respect to the entire valve contact face side layer by a mass %, and wherein the supporting material side layer is formed of iron base sintered alloy having a base matrix composition containing 0.2 to 2.0% of C and the balance being Fe and inevitable impurities by a mass %, wherein the valve contact face side layer has a base matrix structure in which 0.5 to 4% of solid lubricant particles are dispersed in the base matrix phase with respect to the entire valve contact face side layer by a mass % in addition to the base matrix structure, and wherein the coolant is a material having higher thermal conductivity than the material of the valve.

2. An assembly comprising:

a valve; and a valve seat insert for an internal combustion engine, wherein the valve is comprised of a material having thermal conductivity of 5 to 45 (W/m·K) at 20 to 1000° C., the valve comprises a stem and a head integral at an end of the stem, the valve has a hollow part formed from the head to the stem, and the hollow part is filled with a coolant and an inert gas, and wherein the valve seat insert has a double-layer structure comprised of a supporting material side layer and a valve contact face side layer, the supporting material side layer has thermal conductivity of 23 to 50 (W/m·K) at 20 to 300° C., and the valve contact face side layer has thermal conductivity of 10 to 22 (W/m·K) at 20 to 300° C., the supporting material side layer and the valve contact face side layer each being an iron base sintered alloy, wherein the hollow part of the valve comprises i) a large-diameter hollow part provided inside the head, the large-diameter hollow part having an overall substantial disk shape with an upper surface and a lower surface, ii) a small-diameter hollow part provided in the stem, the small-diameter hollow part having a substantially linear shape, and iii) an opening between the large-diameter hollow part and the small-diameter hollow part, wherein the large-diameter hollow part communicates with the small-diameter hollow part through the opening, the large-diameter hollow part being substantially orthogonal to the small-diameter hollow part, wherein the opening between the large-diameter hollow part and the small-diameter hollow part is located along a top planar portion of the upper surface of the large-diameter hollow part, the top planar portion being in a plane substantially orthogonal to a center axis line of the valve, wherein the upper surface includes an eave-shaped annular step part located around the top planar portion, wherein the large-diameter hollow part has an overall conical trapezoid shape having a tapered outer peripheral face substantially similar to the outer shape of the head, wherein the material of the valve is one of heat-resistant steel and the equivalent thereof or Ni base alloy and the equivalent thereof, wherein the valve seat insert formed of the iron base sintered alloy is formed so that a boundary face between the valve contact face side layer and the supporting material side layer is formed within an area surrounded by a face having an angle of 45° formed with respect to a valve seat insert axis and having a circular line distant by 0.5 mm from a valve contact face toward a supporting material in a direction perpendicular to the valve contact face at a center position of the valve contact face in the width direction and a face having a circular line of ½ of a valve seat insert height as a distance from a valve seat insert seating face on the outer peripheral face of the valve seat insert and an intersection line between the valve seat insert seating face and the inner peripheral face of the valve seat insert, wherein the valve contact face side layer is 10 to 60% as a volume % with respect to the entire valve seat insert, wherein the valve contact face side layer is formed of iron base sintered alloy having a base matrix in which hard particles are dispersed in a base matrix phase, the base matrix has a base matrix composition containing 0.2 to 2.0% of C, 40% or less of one or two or more selected from Co, Mo, Si, Cr, Ni, Mn, W, V, and S in total and the balance being Fe and inevitable impurities by a mass %, and the base matrix has a base matrix structure in which 5 to 40% of the hard particles are dispersed in the base matrix phase with respect to the entire valve contact face side layer by a mass %, and wherein the supporting material side layer is formed of iron base sintered alloy having a base matrix composition containing 0.2 to 2.0% of C and the balance being Fe and inevitable impurities by a mass %, wherein the supporting material side layer has a structure in which 0.5 to 4% of solid lubricant particles are dispersed in the base matrix phase with respect to the entire supporting material side layer by a mass %, and wherein the coolant is a material having higher thermal conductivity than the material of the valve.

3. The assembly of the valve and the valve seat insert for the internal combustion engine according to claim 1, wherein the valve is padded on at least a contact area with respect to the valve seat insert on the valve face.

4. The assembly of the valve and the valve seat insert for the internal combustion engine according to claim 2, wherein the valve is padded on at least a contact area with respect to the valve seat insert on the valve face.

5. The assembly of the valve and the valve seat insert for the internal combustion engine according to claim 1, wherein a width of the lower surface of the large-diameter hollow part is greater than twice a maximum height of the large-diameter hollow part.

6. The assembly of the valve and the valve seat insert for the internal combustion engine according to claim 2, wherein a width of the lower surface of the large-diameter hollow part is greater than twice a maximum height of the large-diameter hollow part.

7. The assembly of the valve and the valve seat insert for the internal combustion engine according to claim 2, wherein the valve contact face side layer has a base matrix structure in which 0.5 to 4% of solid lubricant particles are dispersed in the base matrix phase with respect to the entire valve contact face side layer by a mass % in addition to the base matrix structure.

8. The assembly of the valve and the valve seat insert for the internal combustion engine according to claim 2, wherein the supporting material side layer contains 20% or less of one or two or more selected from Mo, Si, Cr, Ni, Mn, W, V, S, and P in total by a mass % in addition to the base matrix composition.

* * * * *